US009777446B2

(12) United States Patent
Nes

(10) Patent No.: US 9,777,446 B2
(45) Date of Patent: Oct. 3, 2017

(54) DEVICE TO TRANSFER PERSONNEL AND MATERIALS TO AND FROM A LAND SITE AND USE THEREOF

(71) Applicant: Cruise Ventures AS, Veitastrond (NO)

(72) Inventor: Asbjørn Nes, Veitastrond (NO)

(73) Assignee: Cruise Ventures AS, Veitastrond (NO)

( * ) Notice: Subject to any disclaimer, the term of this patent is extended or adjusted under 35 U.S.C. 154(b) by 0 days.

(21) Appl. No.: 15/037,744

(22) PCT Filed: Nov. 20, 2014

(86) PCT No.: PCT/NO2014/050216
§ 371 (c)(1),
(2) Date: May 19, 2016

(87) PCT Pub. No.: WO2015/093967
PCT Pub. Date: Jun. 25, 2015

(65) Prior Publication Data

US 2016/0298304 A1 Oct. 13, 2016

(30) Foreign Application Priority Data

Nov. 20, 2013 (NO) ..... 20131559

(51) Int. Cl.

| | |
|---|---|
| ***E01D 15/00*** | (2006.01) |
| ***E01D 15/20*** | (2006.01) |
| ***B63B 35/00*** | (2006.01) |
| ***E01D 15/24*** | (2006.01) |
| ***B63B 27/14*** | (2006.01) |

(52) U.S. Cl.
CPC ..... *E01D 15/20* (2013.01); *B63B 27/14* (2013.01); *B63B 35/00* (2013.01); *E01D 15/24* (2013.01)

(58) Field of Classification Search
CPC ..... E01D 15/20; E01D 15/24; B63B 27/14; B63B 35/00
USPC ..... 14/2.4–2.6, 69.5; 114/362
See application file for complete search history.

(56) References Cited

U.S. PATENT DOCUMENTS

| | | | | |
|---|---|---|---|---|
| 2,321,677 A * | 6/1943 | Higgins | ..... | E01D 15/22 114/344 |
| 3,581,701 A * | 6/1971 | Gehlen | ..... | E01D 15/22 14/71.1 |
| 4,145,786 A * | 3/1979 | Myers | ..... | E01D 15/20 14/2.4 |

(Continued)

*Primary Examiner* — Raymond W Addie
(74) *Attorney, Agent, or Firm* — Francis C. Hand; Carella, Byrne, et al

(57) ABSTRACT

A floating device for transfer of personnel and material to and from the shore, where the device is divided into sections that are mutually brought together by articulated couplings to form an extended, continuous path for the transfer of said personnel and material, as the sections are set up to be reset between a parked, folded position and an extended, using position. The device is characterized by a first section (10) that comprises mutually separated hull sections (14, 16) that are connected via a deck (12) where the other sections (20, 30) in the device are set up to be parked in under the deck (12) between the hull parts (14, 16) of the first section (10), and also that the device comprises means to securely couple the other sections (20, 30) to the first section (10) up under the deck, as the hull parts can be ballasted to be able to raise and lower the first section (10) with regard to the other sections (20, 30).

13 Claims, 4 Drawing Sheets

(56) References Cited

U.S. PATENT DOCUMENTS

| | | | | | |
|---|---|---|---|---|---|
| 4,621,385 | A * | 11/1986 | Gillois | B60F 3/0061 | 14/2.4 |
| 5,573,363 | A * | 11/1996 | Rohr | B63B 27/22 | 414/138.7 |
| 6,000,358 | A * | 12/1999 | Dickenson | B63B 1/06 | 114/344 |
| 6,722,931 | B2 * | 4/2004 | Eberl | E01D 15/22 | 14/2.6 |
| 6,868,799 | B2 * | 3/2005 | Wright | B63B 27/143 | 114/343 |
| 7,021,228 | B2 * | 4/2006 | Robb | B63B 7/04 | 114/125 |
| 7,028,632 | B2 * | 4/2006 | Blank | B63B 27/143 | 114/362 |
| 8,056,496 | B1 * | 11/2011 | Bussa | B63B 27/146 | 114/362 |
| 9,221,520 | B2 * | 12/2015 | Roy | E01D 15/20 | |
| 9,302,740 | B2 * | 4/2016 | O'Neal | B63B 1/14 | |

* cited by examiner

DEVICE TO TRANSFER PERSONNEL AND MATERIALS TO AND FROM A LAND SITE AND USE THEREOF

The present invention relates to a floating device for the transfer of personnel and material to and from a landing site (a beach) where the device is divided into sections that are mutually folded with articulated couplings to form an extended continuous path for transfer of said personnel and materials, as the sections are arranged to be re-set between a parked, folded state and an extended, using state.

In more detail the invention relates to a new device to transfer personnel and equipment, usually heavy, rolling equipment, onto land or on board a ship where there are no harbour facilities.

Furthermore, the invention relates to an application of the device to serve a vessel.

The type of vessel to which the invention relates is often called a landing vessel to place personnel, vehicles or other material on a beach or the like.

The present invention is particularly related to situations where cargo shall be brought on board or ashore from a ship that lie some distance from land (the beach).

BACKGROUND OF THE INVENTION

Such a vessel often has the form of a barge or loading pram that can be described as a floating platform (or loading) box that can be driven with or without its own drive unit. Normally these have a flat bottom. The cargo is transferred between land (the beach) and the vessel with the help of ramps or skids, or the barge can be partially driven onto, for example, the beach. Such vessels are also equipped with their own propulsion engine. The shape of the hull is typically flat, something which makes them applicable in still waters and in shallow waters.

An example of such a situation is described in WO 2011/005112 where a foldable, floating gangway, composed of individual sections, that runs from an anchoring site on land and out to a ship anchored some way out to sea. The gangway can be folded completely horizontally in a space saving way when it is parked and inactive.

Moreover, reference is made to U.S. Pat. No. 5,573,363 which describes a raft construction where the one outermost section in such an articulated construction is a raft section that is anchored. The construction lies in a zigzag pattern over the sea up to the raft construction. Furthermore, reference is made to the publication RU-513902.

Through the ages unloading or loading a ship has presented large challenges and many resources have been used to tackle these challenges by building large, costly harbour installations. It has always been particularly challenging to get warships and transport ships unloaded in connection with landing operations during a war.

Existing harbours in the area will then, in many cases, be damaged, have mines laid or have a military protection in the form of many different weapon systems, something which makes it impossible or unacceptable because of the risk of large losses, to use existing harbours in the area. Therefore it is an indisputable wish to be able to find alternative sites in the vicinity to set ashore troops and heavy military equipment without having to risk unacceptably heavy losses.

THE AIM OF THE INVENTION

It is an aim of the invention to provide a new construction for a barge to transfer personnel and cargo to and from the shore. For example, to form a transport connection between the shore and a ship at roadstead, for example, between two ships. This invention tackles this challenge.

It is a further aim of the invention to provide a construction that is very compact when in a storage position where the sections are coupled tightly to each other, but they can be unfolded to an extended using position.

Furthermore, it is an aim to couple a number of the sections in under a deck surface of a catamaran-mother section and then to lift the sections up above the water line by a suitable ballasting of the catamaran hull parts in the mother section.

PRESENT INVENTION

The device according to the invention is characterised by a first section that comprises mutually separated hull parts that are connected via a deck where the other sections in the device are set up to be parked in under the deck between the hull parts of the first section, and also that the device comprises means to securely couple together the other sections to the first section underneath the deck, as the hull parts can be ballasted to be able to raise and lower the first section with regard to the other sections.

It is preferred that the first section is a catamaran with a deck and longitudinal hulls that can be ballasted which comprises propulsion machinery to drive it forward in the sea.

It is particularly preferred that the underside of the deck of the first section and the topside of the second section comprise collaborating gliding/steering bodies to lead the second section in and out from under the deck between the two catamaran hulls.

According to a preferred embodiment the collaborating gliding/steering bodies are made up of a longitudinal, undercut groove in the underside of the deck in which an enlarged head of an upwardly extending peg in the topside of the section in its one end is set up to run, and also that the end of the groove comprises a stopping body to prevent the peg/head from gliding out of the groove.

According to yet another preferred embodiment said gliding/steering bodies make up the coupling between the first section and the second section when the section is extended into the using position.

The means to couple together the other sections to the first section under the deck preferably comprises that the underside of the first section and the topside of the other sections comprise mutually connectable male and female bodies and associated locking bodies that can be dismantled, to fasten the section underneath the deck.

It is particularly preferred that the collaborating male and female bodies comprise pegs set up to be led into respective channels, whereby they are locked together with the help of locking latches on the topside of the deck of the section.

Furthermore, it is preferred that the catamaran section can be raised by the removal of water from the catamaran hulls so that the fastened sections are, in their entirety, lifted above the waterline.

It is preferred that the sections are fitted with one or more propulsion propeller units that can, for example, be turned.

According to a preferred embodiment, the outer section is fitted with one or more propeller units which can be, for example, side propeller units.

The catamaran section is preferably made up of a mother section and also two further floating sections linked together via hinged joints end to end, as the outermost (the third) section is the one that is coupled to land.

The outermost, third section is preferably fitted with a belt unit that makes it possible to drive parts, or the whole, of the section up on dry land when they hit the sea bed during the drive towards the shore.

Furthermore, it is preferred that the outermost section is fitted with a winch unit to pull the outermost section up on land.

According to the invention, the device is applied to form a gangway connection between a ship and the shore, in that the mother/catamaran section is connected to the ship, while the other sections are stretched out towards the shore where the outermost section is anchored for the transport of personnel between the shore and the ship.

The concept according to the invention comprises a number (in particular three) of sections that are connected end to end in a row with the help of associated swing disc joints. The joints have a certain similarity to the swing disc joints which one finds today in trailers that shall be connected to a hauling wagon, for example, in different types of road trains.

In particular, the concept is comprised of three sections including the mother section.

FIGURES TO SHOW THE INVENTION

The invention shall be explained in more detail with reference to the enclosed figures, in which.

DETAILED DESCRIPTION OF THE INVENTION

Figures 1, 1A:
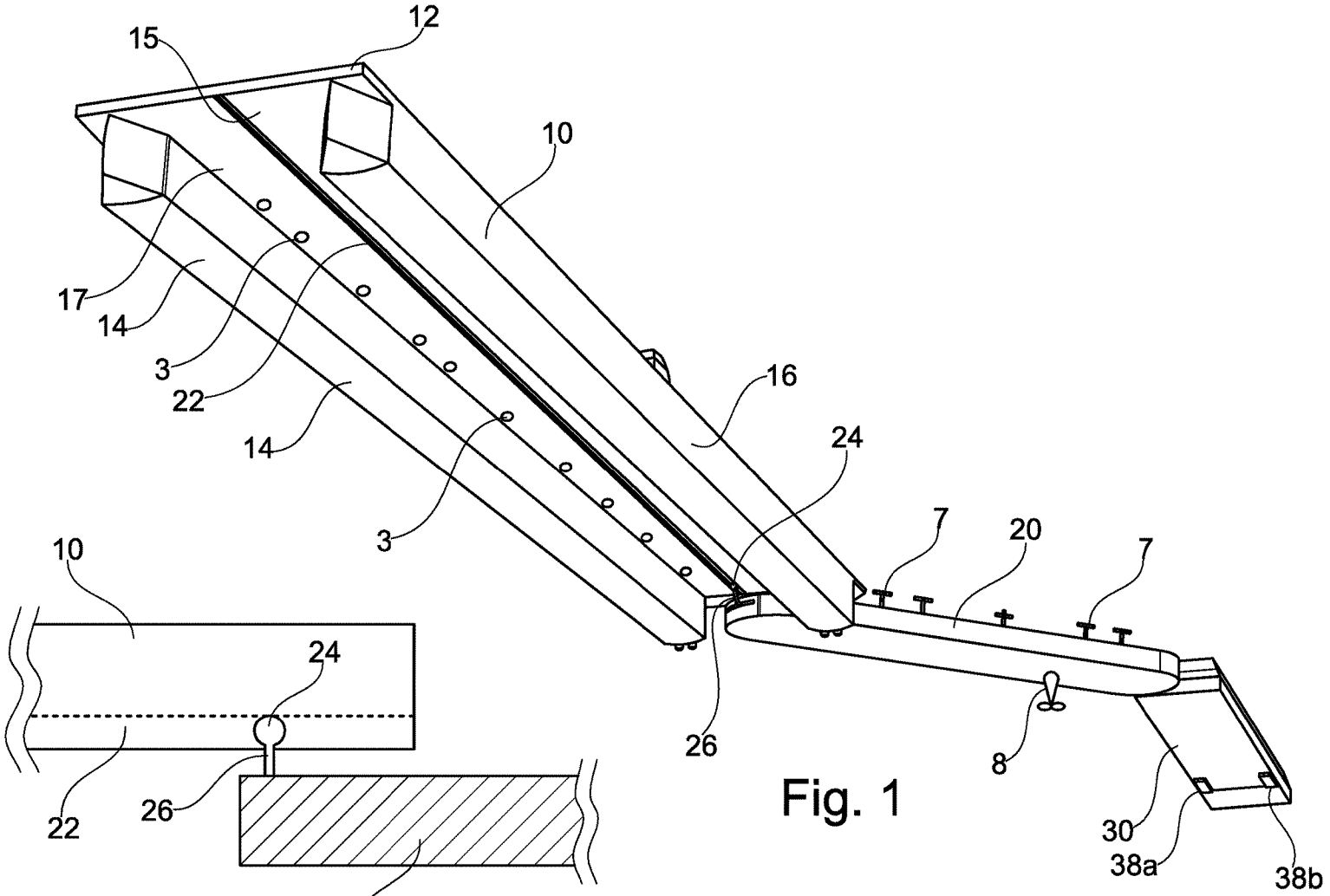
FIG. 1 shows a perspective of the inventive construction seen at an angle up from the underside and is comprised of three floating sections that are respectively coupled together end to end.
FIG. 1A shows how a gliding connection between the mother section and the connected section can be made.

The invention shall now be explained in more detail with reference to FIG. 1.

The construction comprises three extended floating sections 10, 20 and 30 that are coupled together end to end, respectively, to float on the sea. The sea line is shown by the reference number 11 in FIG. 2.

The one section 10 is set up to take up and store the other sections 20 and 30 in a compact setting, in the case shown there are two sections. The section 10 comprises an upper deck 12 for placing of the cargo, while its underside comprises a number of float elements along each side edge so that a space 15 is formed between these to take up the other elements during storage. According to a preferred embodiment, the float elements are formed by two longitudinal hollow hull sections 14 and 16, respectively, so that the section 10 appears as a catamaran construction.

The section 10 can be described as a mother section as it is this section that shall store the other sections and it encompasses a propulsion system.

Closed separate machine rooms for propulsion machines, such as for propeller operation or water jet operation, are arranged in each hull 14 and 16. According to an example, the propulsion machine is designed to be able to give the catamaran a propulsion/speed of up to 20-30 knots.

The other parts of the hollow hull parts 14 and 16, respectively, define buoyancy tanks/ballast tanks. The tanks 14,16 are ballasted suitably with water with the help of pumping bodies, so that the catamaran can be raised and lowered in the sea. Thus, water is let into or pumped out of the tanks 14,16. For example, when the deck 12 in the construction carries a lot of cargo, the tanks can be completely filled with air, i.e. all the water is pumped out and replaced by air.

Thus, the section 10 is a catamaran construction comprised of two separate hulls 14 and 16 which between them carry a deck 12 that lies above the water surface. Furthermore, on top of the deck is a wheelhouse (not shown) with the necessary equipment to serve all functions, such as propulsion machinery, ballasting pumps and ballasting valves and operation of the coupling means to fasten the sections 20 and 30 to the mother section 10, and also flaps for going ashore. The deck between the two hulls is, for example, a trusswork strengthening construction with an upper deck surface 12 and can have a thickness of about 1 meter.

According to an example, the catamaran can have a length of 110 meters and a width of 20 meters, where each hull has a width of 4.5 meters and the distance between the two hulls is 11 meters.

The underside 17 of the deck 12 comprises a longitudinal guiding groove 22 to set up a glide fastening in connection to the section 20, such as in the form of an undercut groove, set up to take up a rounded head 24 on a bolt 26 that extends up from the topside of the end of the section 20. This functions corresponding to a bolt/swing disc as a glide fastening that goes on the underside of the catamaran section 10 along the whole of its length. This constitutes an introductory coupling between the section 10 and the section 20 for the going in and out of the section 20 in under the section 10. The groove 22 comprises a stopper so that the section 20 cannot be pulled completely from the section 10.

When the section 20 shall be stored in the section 10, it is pushed in between the catamaran hulls 14 and 16, as the bolt head 24 is led forward in the undercut groove 22. Thereby, a controlled pushing in of the section 20 is obtained in under the section 10 under the deck 12 and between the catamaran hulls/catamaran chambers 14 and 16, respectively.

Based on this it appears that the floating barge section 20 is narrower than the distance between the hulls 14,16, i.e. less than 11 meters when one follows the dimension example above, such as a length of 25 meters and a width of 10 meters. The section 20 can also be ballasted with a mixture of air and water to achieve a correct floating position in the sea.

Furthermore, the section 20 can be fitted with one or more azimuth thrusters 8 that extend down into the sea under the bottom of the section 20. This thruster 8 is used to manoeuvre the section 20 out of and in to the underside of the section 10 and otherwise in other positions.

A series of upwardly extending bolts 7 are fitted on the topside of section 2, along each side, the lengths of which are longer than the thickness of the deck 12, between the hulls 14,16 of the catamaran. These bolts 7 are adjusted to existing holes 3 in the deck 12 of the catamaran 10. When the section 20 glides in between the hulls 14,16 and the gliding bolt 24 comes to its forward position, the bolts 7 are level with the openings 3 in the deck. In the lowering down of the section 10 at a suitable ballasting, the bolts 7 glide up in the holes 3 and lock the section 20 to the section 10 in a stable assembly. Gripping pegs (not shown) can also be mounted in the section 10, that grip around the upwardly extending bolts 7 so that the section 20 is securely locked to the underside of the mother section 10.

The raising and lowering of the sections 20 and 30 for fastening to the mother section 10 can also be carried out in that the sections 20 and 30 are raised up under the deck 12 by the pumping out of water.

Figure 2:
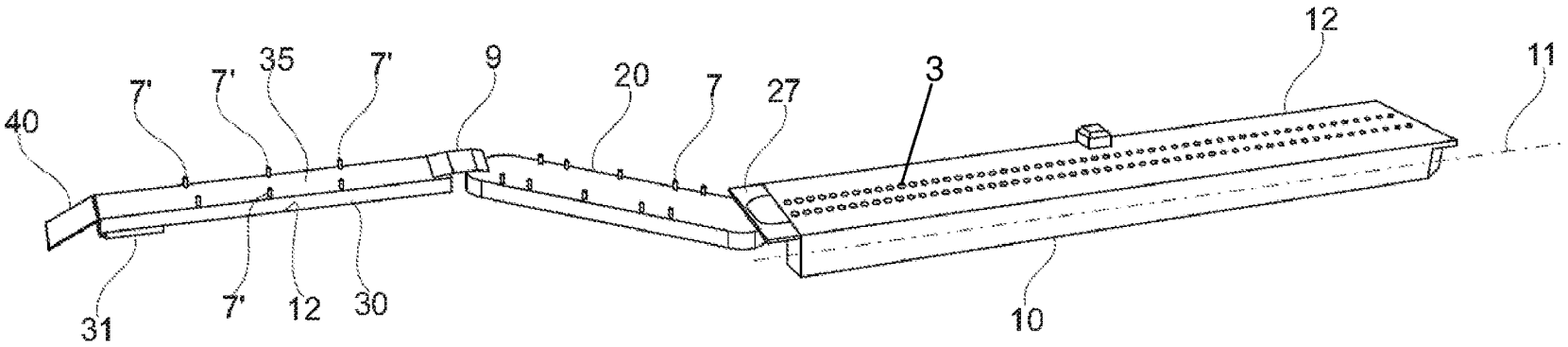
FIG. 2 shows a perspective corresponding to the construction seen at an angle down from the topside.

FIG. 2 shows a hinged flap/plate 27 that forms a level transition between the top deck 12 on the first section 10 and the top surface of the second section to simplify traffic and transfer of personnel/cargo between the two sections.

Section 30

Figure 3:
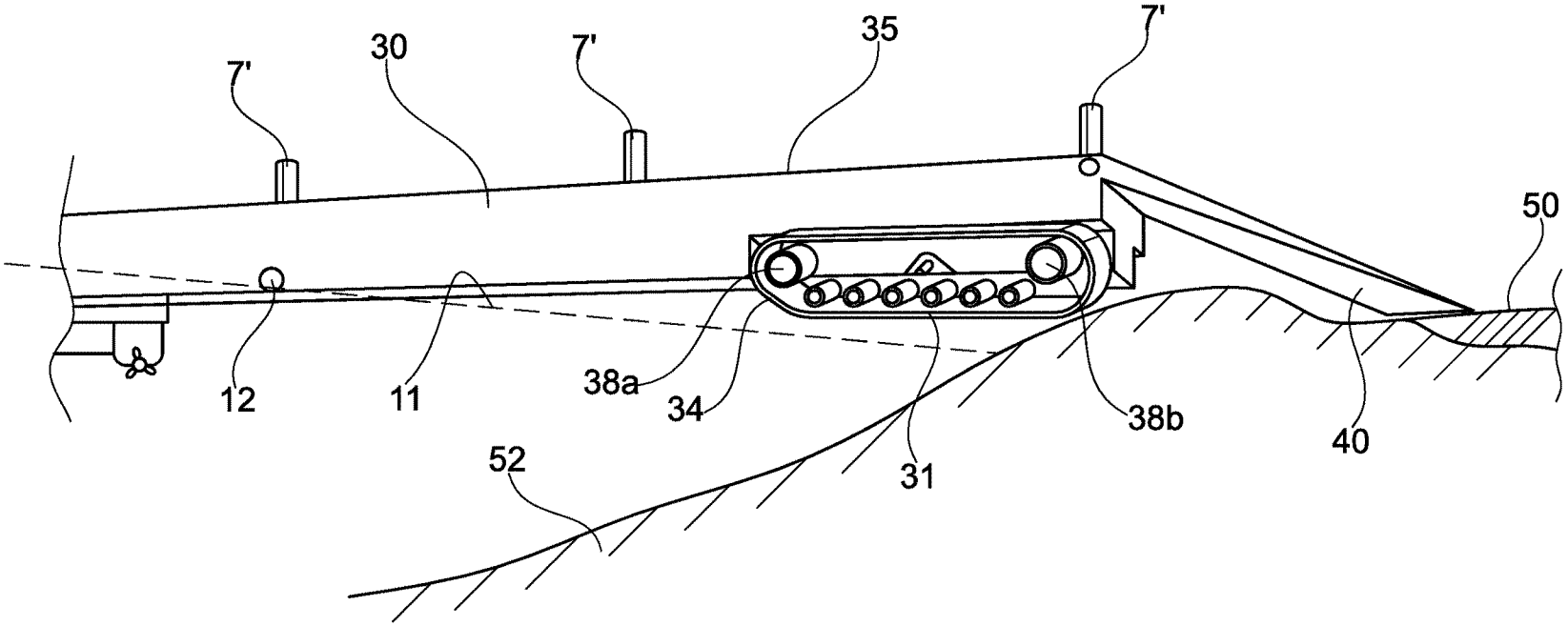
FIG. 3 shows an enlarged perspective of the end section facing land.

The third section in the row is shown by 30, and is also a floating section that can be ballasted, having approximately the same width as section 20 so that it can also be placed in between the hull parts 14 and 16, respectively, in the section 10. However, the section 30 is fastened to the end of the section 20 (the middle section) by a swing disc joint 9 or a universal joint corresponding to the fastening between the section 10 and the section 20. However, the section 30 has no gliding path for the leading in between the catamaran hulls in the section 10 as it is suspended in the end of the section 20. The section 30 is fitted with a side propeller unit 112 (FIGS. 2 and 3) and upwardly extending bolts 7' corresponding to the bolts 7 on the section 20, with associated holes in the deck of the section 10. As the section 30 is fixed to the section 20 via the swing disc joint 9, it is pulled behind the section 20 when this is driven in between the catamaran hulls 14-16 in the section 10. When the bolts 7' are in place they will be forced up through the through-running holes in the deck 12 on the section 10, and when these are locked with the help of locking latches (not shown) both the sections 30 and 20 are securely fastened in under the mother section 10.

When the mother section is sufficiently raised in the sea by an appropriate ballasting, the two other sections can be completely lifted up from the sea 11, and the mother section can be driven in the sea by the propulsion machinery without the connected sections dragging in the sea and generating a resistance to the propulsion, when it shall run, for example, at a speed of up to 20 knots in the sea. This is one of the aims of the inventive construction.

In addition, the forward free end of the section 30 is fitted, at its bottom edge, with a continuous caterpillar belt unit 31, i.e. comprising two continuous belts 34 (one on each side) that run over the rear and forward drive wheels 38*a* and 38*b*, respectively, and the lower guiding wheels against the foundation.

A hydraulically hinged trap door 40 is fitted over the belts on the deck 35 of the section 30, that can be raised and lowered as the trap door 40 is placed in towards land 50.

As a consequence of what is described above, the sections 20 and 30 can be pulled in under the section 10 (the catamaran). The section 10 is then first raised some by an appropriate emptying of water and inflow of air so that there is room for both the section 20 and the section 30, as these are led in under the section 10 between the catamaran hulls 14,16 with the help of the propeller units shown.

Thereafter, the section 10 is lowered again by a new filling of water, again so that the bolts on the sections 20 and 30 are fed up through the holes 3 in the deck 12 on the section 10 and are locked on the topside with the help of said locking latches. Thereafter, the section 10 can again be raised by replacing water by air inside the pontoons 14,16 and the sections 20 and 30 are raised upwards again as they hang fixed under the deck 12 of the section 10.

In this mode, the assembled sections 10,20,30 can be transported.

A Practical Embodiment Example

When the construction is used in connection with a military landing, we can imagine the following scenario:

It is decided that the military landing shall take place on a deserted beach, where the bottom slopes very gradually. A series of transport ships in a convoy are on their way to the actual site, together with the usual military support units.

Figure 4:
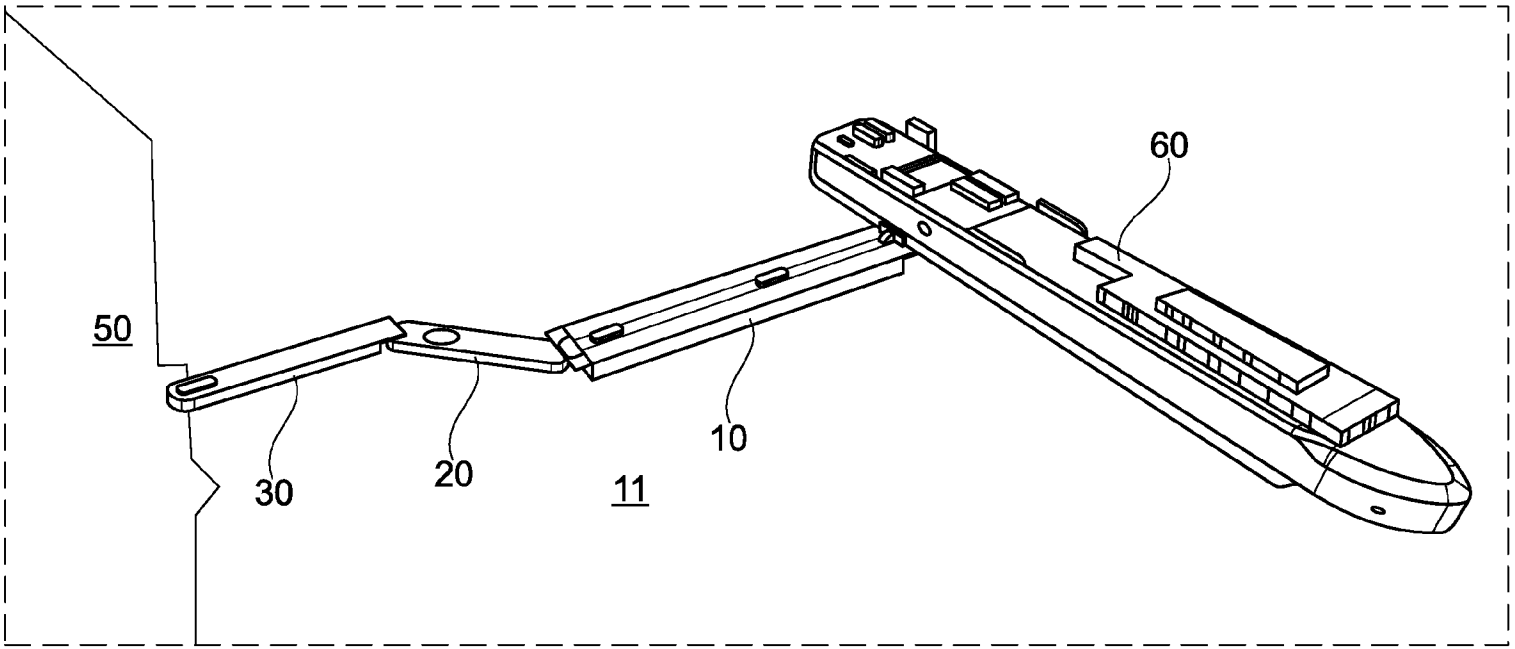
FIG. 4 shows how the construction is used to transfer cargo/personnel between the shore and a ship out on the sea.

In the convoy, there is also a construction according to the invention. When the construction arrives at the beach where the landing shall take place, it lies in a position about 300 meters from the shore. The inventive construction is lowered by letting in water and the locking bolts that fix the sections 20 and 30 are released and the section 10 raises itself again. The sections 20 and 30 are pulled out from the aft end of the section 10. The swing disc joint between the sections 10 and 20 is locked in the correct position. The angle between the three sections, for example, as a zigzag pattern as shown in FIGS. 1 and 4, is set and the sections are moved in towards the beach with the section 30 in front to perform the landing. To keep the correct position and angles, all propeller systems associated with the sections are used.

Closer to the land shore, the caterpillar belts at the end of the section 30 will hit the bottom 52 (FIG. 3) and they are then activated to roll and will pull the section 30 so far up on the beach as is required. Thereafter, the hydraulic trap-door 40 is lowered down onto the beach.

If it is necessary, the section 10 can comprise separate anchoring bodies such as anchors in the anchoring ropes that are operated by a windlass.

The inventive construction is now operative and the first transport ship 60 (FIG. 4) can dock at the outermost construction which is section 10. The ship 60 can use its own stern and aft anchors. In addition it can use dynamic and automatic positioning (GPS) if this is required and available. It the ship is a so called Ro-Ro ship, it will be able to be unloaded in a very short time and tanks can, for example, be driven directly onto land over the three sections 10, 20 and 30.

The construction according to the invention can, because of its great mobility and speed, also be used in a series of civilian operations and commercial applications related to different offshore and installation activities.

The invention claimed is:

1. A floating device for transfer of personnel and material to and from a shore, said device comprising a plurality of articulated sections being movable from a parked position with said sections disposed in a stacked array and to an extended position with said sections forming a continuous path for the transfer of personnel and material, a first section of said articulated sections having a deck and mutually separated hull sections at side edges of said deck defining a space therebetween;

the other sections of said articulated sections being disposed under said deck and in said space in said parked position; and means for securely coupling said other sections to said first section to permit said hull sections to be ballasted to raise and lower said first section relative to said other sections.

2. A floating device as set forth in claim 1 wherein said first section forms a catamaran and includes propulsion machinery for driving said first section in a sea.

3. A floating device as set forth in claim 1 further comprising means for slidably guiding a topside of an uppermost section of said other sections in an underside of said deck and between said hull sections.

4. A floating device as set forth in claim 3 wherein said means for slidably guiding includes a longitudinal undercut groove in said underside of said deck and an enlarged head on an upwardly extending peg at one end of said topside of said uppermost section, said head being slidably disposed in said groove.

5. A floating device as set for forth in claim 4 further comprising a stopping body in one end of said groove to prevent said peg from sliding out from said groove.

6. A floating device as set forth in claim 4 wherein said groove and said head form a coupling between said first section and said uppermost section in said extended position.

7. A floating device as set forth in claim 1 wherein said plurality of articulated sections include male and female bodies for mutually folding of said articulated sections together and associated detachable locking bodies to fasten said other sections under said deck of said first section.

8. A floating device as set forth in claim 7 wherein said male and female bodies include pegs on one of said other sections slidably mounted in respective channels of another of said other sections.

9. A floating device as set forth in claim 1 further comprising at least one propulsion/propeller unit on at least some of said plurality of sections for turning of said respective section in a sea.

10. A floating device as set forth in claim 1 further comprising a side propeller unit on a lowermost section of said other sections.

11. A floating device as set forth in claim 1 wherein said other sections are hinged together.

12. A floating device as set forth in claim 1 wherein a lowermost section of said other sections includes a belt unit for driving onto dry land.

13. A floating device as set forth in claim 1 wherein a lowermost section of said other sections includes a winch unit for pulling onto land.

* * * * *